US011758950B2

(12) United States Patent
Zhang

(10) Patent No.: US 11,758,950 B2
(45) Date of Patent: Sep. 19, 2023

(54) MEDICINAL UNDERWEAR FOR REDUCING PRESSURE

(71) Applicant: Holly Zhang, Wayland, MA (US)

(72) Inventor: Holly Zhang, Wayland, MA (US)

( * ) Notice: Subject to any disclaimer, the term of this patent is extended or adjusted under 35 U.S.C. 154(b) by 0 days.

(21) Appl. No.: 16/751,260

(22) Filed: Jan. 24, 2020

(65) Prior Publication Data

US 2021/0227895 A1 Jul. 29, 2021

(51) Int. Cl.
*A41B 9/14* (2006.01)
*A41B 17/00* (2006.01)

(52) U.S. Cl.
CPC ..... *A41B 9/14* (2013.01); *A41B 17/00* (2013.01); *A41B 2400/34* (2013.01)

(58) Field of Classification Search
CPC ..... A41B 9/14; A41B 17/00; A41B 2400/34; A41B 11/04; A41F 9/00
USPC ..... 2/402, 403, 404, 406, 407, 220, 236, 69, 2/237
See application file for complete search history.

(56) References Cited

U.S. PATENT DOCUMENTS

| | | | | |
|---|---|---|---|---|
| 4,602,388 | A * | 7/1986 | Underwood | A41D 1/089 2/238 |
| 4,615,051 | A | 10/1986 | Hashimoto | |
| 5,363,511 | A | 11/1994 | Brewer | |
| 8,347,418 | B2 | 1/2013 | Murata | |
| 9,095,176 | B2 | 8/2015 | Roberts et al. | |
| 9,277,771 | B2 | 3/2016 | Bakker et al. | |
| 10,244,798 | B2 | 4/2019 | Wexler | |
| 10,750,793 | B1 * | 8/2020 | Theodoridis | A41B 9/02 |
| 2006/0021116 | A1 * | 2/2006 | Protting | A41F 9/02 2/404 |
| 2016/0286879 | A1 | 10/2016 | Farmer et al. | |

* cited by examiner

*Primary Examiner* — Nathan E Durham
*Assistant Examiner* — Abby M Spatz

(57) ABSTRACT

A medicinal pair of underwear is configured to reduce pressure exerted against a women's body to reduce or remove pain caused by underwear due to nerve pain in the abdomen, thigh, genital area, or hip crease. The underwear includes a front waistband that is connected to a front portion of the underwear via stitching, and a rear waistband that is connected to the rear waistband via stitching. The stitching for the front and rear waistbands do not engage, that is, there is a gap present between the stitching for the rear waistband and the front waistband to reduce the amount of pressure exerted while the medicinal underwear is worn. The collective structural features provide a loose-fitting medicinal pair of underwear that, when worn, stays in place and can be utilized by women who are experiencing nerve pain around the genital and thigh areas.

6 Claims, 9 Drawing Sheets

MEDICINAL UNDERWEAR FOR REDUCING PRESSURE

BACKGROUND

Some people experience pain when wearing certain types of clothing due to a change in their body, surgery, giving birth, or some medical condition or event. For example, some women can experience nerve pain in the abdomen area after having a c-section and some women can experience nerve pain around the thighs and genital area by certain medical conditions, like vulvodynia. These nerve pains can be exacerbated by typical undergarments because the nerves are sensitive to the touch.

SUMMARY

A medicinal pair of underwear configured to reduce pressure exerted against a women's body is implemented to reduce or remove pain associated with wearing underwear caused by nerve pain. The medicinal underwear includes a front waistband portion that is connected to a lower half front portion of the underwear via stitching, and a rear waistband portion that is connected to a lower half rear portion via stitching. The stitching for the front and rear waistband portions do not engage, that is, there is a gap present between the stitching for the rear waistband and the front waistband to reduce the amount of pressure exerted while the medicinal underwear is worn.

The length of the front waistband is substantially congruent to the length of the front portion, whereas the length of the rear waistband is shorter than the length of the rear portion. In typical implementations, the rear waistband portion may be ten percent shorter than the rear portion, but can range anywhere from five to 25 percent depending on the specific implementation. The edges which encircle the leg openings are seamless to also reduce the amount of pressure exerted while the medicinal underwear worn. The collective features and configurations provide a medicinal pair of underwear that can be worn by women who are experiencing pain around one or more of the genital, thigh, hip, hip crease, or abdomen areas, whether due to some form of nerve or other medical condition.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 1:
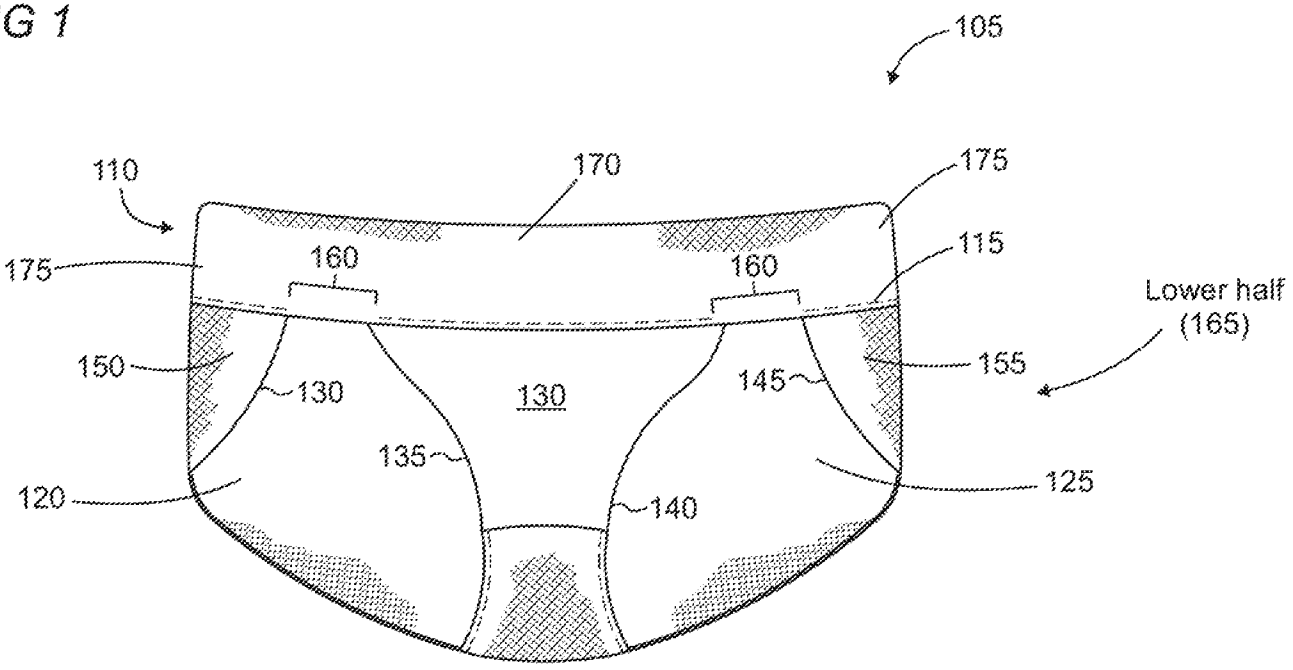
FIG. 1 shows an illustrative representation of a medicinal pair of underwear from a front side view.

FIG. 1 shows an illustrative representation in which a pair of medicinal underwear 105 is configured and implemented to reduce or remove pressure exerted by the underwear near the thigh, genital, and abdomen area, when worn. The medicinal underwear includes a waistband 110 which is attached to various portions of the lower half 165 via stitching (e.g., stitched threads). The waistband, including the front waistband and rear waistband portions described below, is elastic to reduce the amount of pressure exerted against the wearer's abdomen. A front portion 130 of the lower half is attached to the front waistband portion 170 via stitching 115. The length and criteria of the front waistband portion may vary based on the implementation, but typically is the portion which is meant to be at and about a front center of a wearer's body and which aligns with the front portion 130. In typical implementations, the waistband 115 and lower half portions may be constructed of micromodal fabric, but other types of fabric used in combination or individually are also possible (e.g., cotton, polyester, etc.).

The left side region 150 and right side region 155 are respectively connected to a rear waistband portion 175 of the waistband 110. Characterizations of the underwear, such as the left side region 150 and right side region 155, are from an onlooker's vantage point and not the wearer herself. The rear waistband portion extends to the front of the user since the left and right side regions are adapted to wrap around to a front of the user's thighs to keep the medicinal underwear up on the user's waist while still reducing the amount of pressure exerted against at least the user's thighs.

The waistband 110 includes gaps 160 in between the stitching for the front waistband portion 170 and the rear waistband portions 175. The gap prevents the stitching for the front and rear waistband portions from overlapping, which in turn helps reduce the amount of pressure exerted by the waistband and provides greater stretch of the medicinal underwear, when worn.

The medicinal underwear 105 includes a left leg opening 120 and right leg opening 125 to receive a wearer's legs. As mentioned above, the left and right leg opening monikers are used to describe the medicinal underwear from an onlooker's perspective, but when worn the left leg would extend through the right leg opening and the right leg would extend through the left leg opening.

The edges surrounding the leg openings are seamless and non-elastic to prevent the fabric from exerting any pressure against sensitive areas around the legs and thereby reduce or remove pressure. For example, the left and right side region fabric edges 130, 145 on the respective left and right side regions 150, 155 are seamless and are a discontinuance of the fabric itself without a conventional seam that tightens around the wearer's leg. Likewise, the left and right front portion fabric edges 135, 140 of the front portion 130 are seamless and are an abrupt discontinuance of the fabric without a conventional seam.

Figure 2:
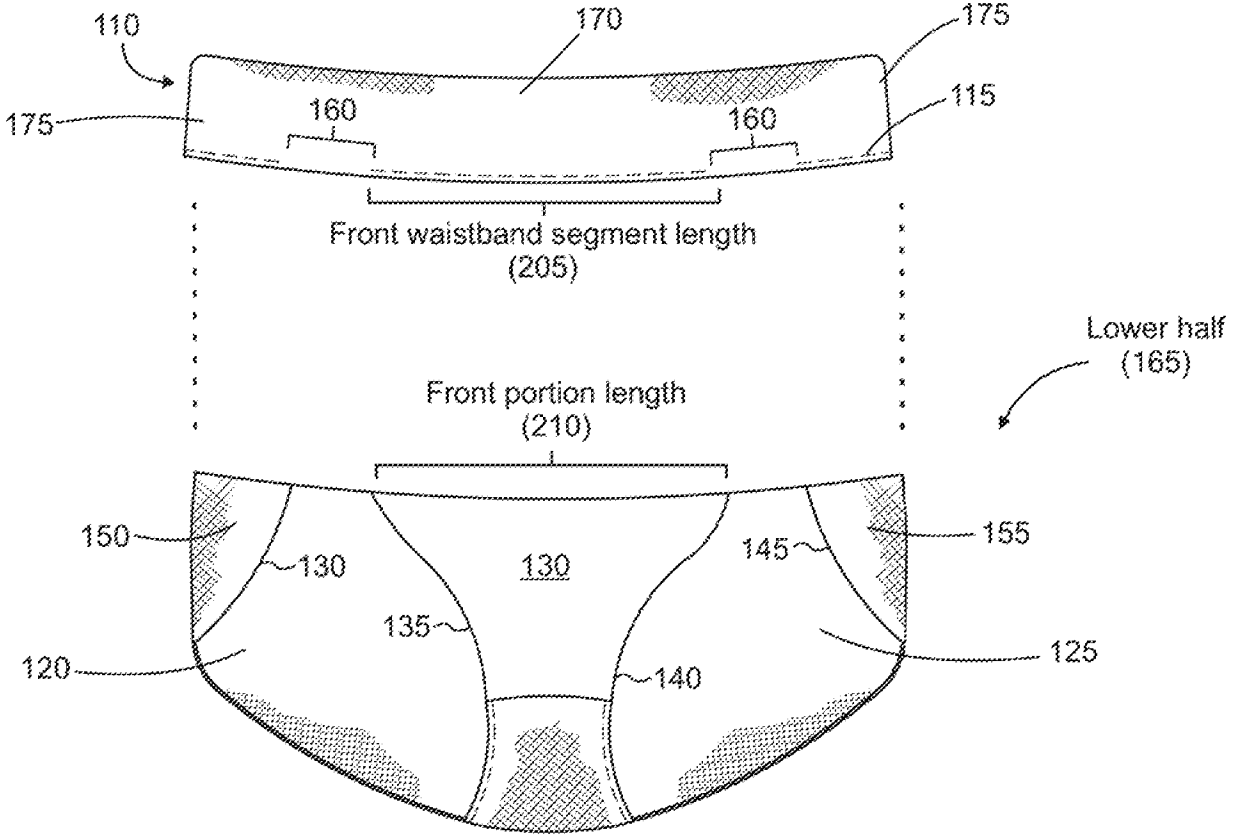
FIG. 2 shows an illustrative representation of the underwear with the waistband detached from the lower half.

FIG. 2 shows an illustrative representation in which the waistband 110 is detached from the lower half 165 for clarity in exposition of the medicinal underwear 105. The front waistband segment length L1 (Length 1) may be congruent or substantially congruent to the front portion length L2 (Length 2) to reduce the amount of pressure exerted when worn. Discussions of the length of the fabric pertain to the amount of fabric used and the ultimate length of the stretched or un-stretched fabric, so long as the comparison is based on both pieces of fabric being stretched or un-stretched. For example, the front waistband and the front portion which connects to the front waistband may each be four inches long so that the medicinal underwear does not uncomfortably tighten when worn by the wearer. This construction can prevent pain exerted against the wearer's abdomen, thighs, or genital area since the front waistband 170 does not include less fabric to secure around the user's waist. As discussed in greater detail below, the combination of the rear waistband 175, rear portion 605 (not shown until FIG. 6), and side regions 150, 155 are constructed to secure the medicinal underwear 105 in place while worn.

Figure 3:
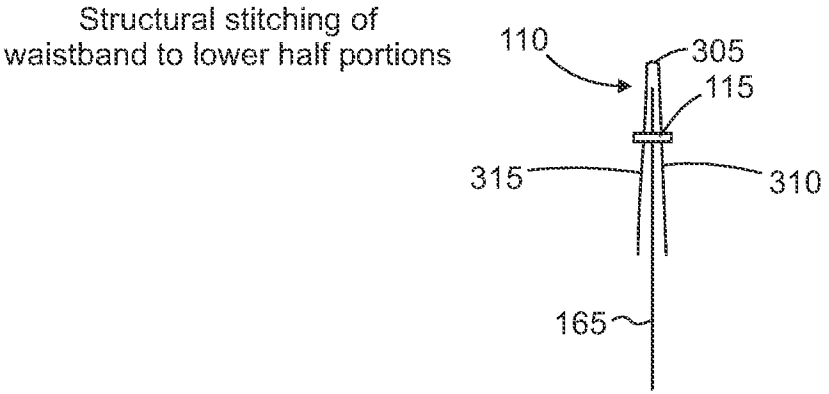
FIG. 3 shows an illustrative representation of how the waistband is stitched to the various lower half portions.

FIG. 3 shows an illustrative representation in which the waistband 110 is stitched to the lower half 165 of the medicinal underwear 105. The waistband is a single piece of fabric folded over at a crease 305 and which attaches at two end portions 310, 315 to the lower half 165. The stitching 115 ties the adjacently positioned fabric together to thereby attach the waistband to the lower half. The lower half may be the front portion 130, left and right side regions 150, 155, and the rear portion 605 (not shown until FIG. 6). While stitching is shown in the drawings and described herein to represent attaching the waistband to the lower half, other implementations are also possible. For example, the two pieces of fabric can be bonded together using some bonding agent, like fabric glue, to provide increased strength to the garment.

In other implementations, an elastic waistband may be utilized which comprises a single piece of elastic fabric that is stitched to the lower half 165 of the medicinal underwear 105. The stitching and length of the waistband may be otherwise the same, but instead of having a folded over fabric as shown in FIG. 3, the waistband may be a single piece of fabric. In either implementation, the width of the fabric may be large enough so that any compression is spread over a larger surface area on the wearer's abdomen and thereby reduce pressure.

Figure 4:
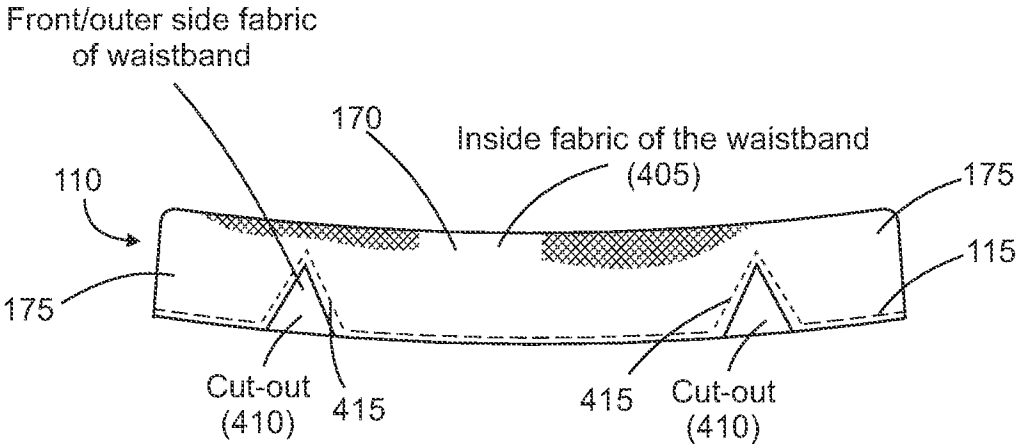
FIG. 4 shows an illustrative representation of an inside fabric of the front waistband portion.

FIG. 4 shows an illustrative representation of the inside fabric 405 of the waistband 110 near the front waistband portion 170. The inside fabric 405 is the portion that would be pressed against the user's abdomen when the medicinal underwear 105 is worn. The inside fabric of the waistband includes two cutout areas 410 in between the stitching of the front waistband portion 170 and the respective rear waistband portions 175. The cutout areas may be V-shaped, U-shaped, or form another shape between the rear and front waistband portions. In the present implementation, the stitching 415 is on the inside fabric 405 and connects to the waistband 105 but does not go through to the front/outer side fabric of the waistband. This configuration enables the front waistband portion 170 and the front portion 130 from tightening and thereby provides a loose fit to reduce the amount of pressure exerted against the user's thighs, abdomen, and genital area.

Figure 5:
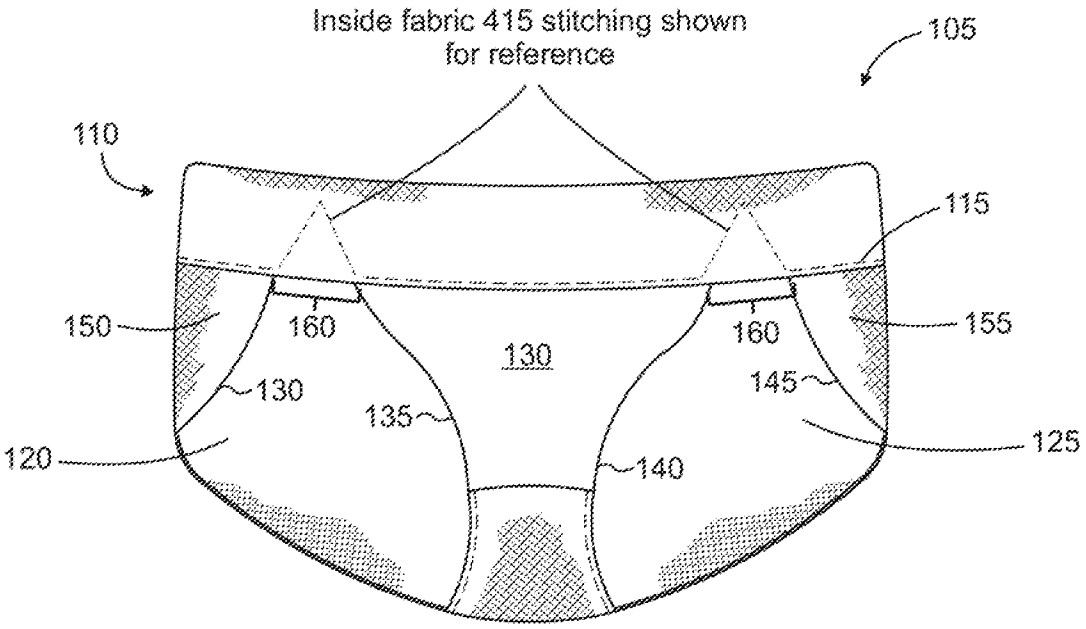
FIG. 5 shows an illustrative representation in which the inside stitching is depicted from the front side of the underwear.

FIG. 5 shows an illustrative representation of the front/outer side of the medicinal underwear 105 in which the inside stitching 415 is representatively illustrated to show its positioning relative to the front side of the waistband 110. The inside stitching 415 is positioned where the gap 160 between the locations of the front waistband portion 170 and rear waistband portion 175. The dash-dotted lines are used to illustrate that the stitching is on the reverse side of the waistband 110, and is not viewable from the front side.

Figure 6:
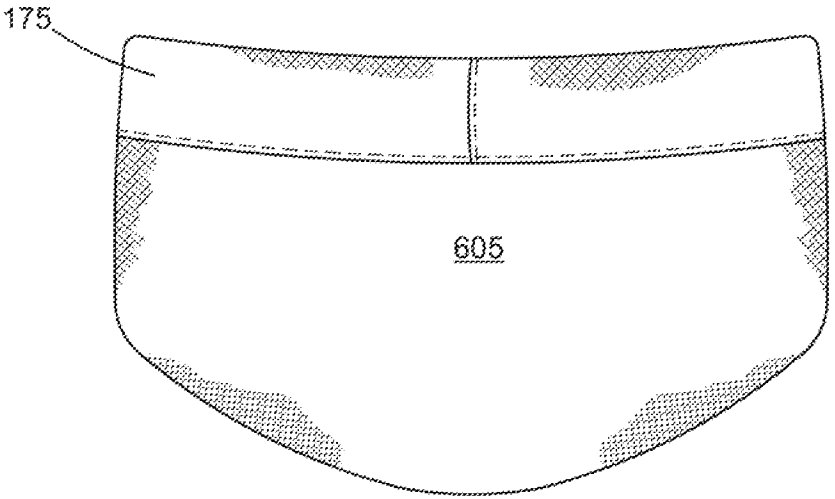
FIG. 6 shows an illustrative representation of the underwear from a rear side view.
Figure 7:
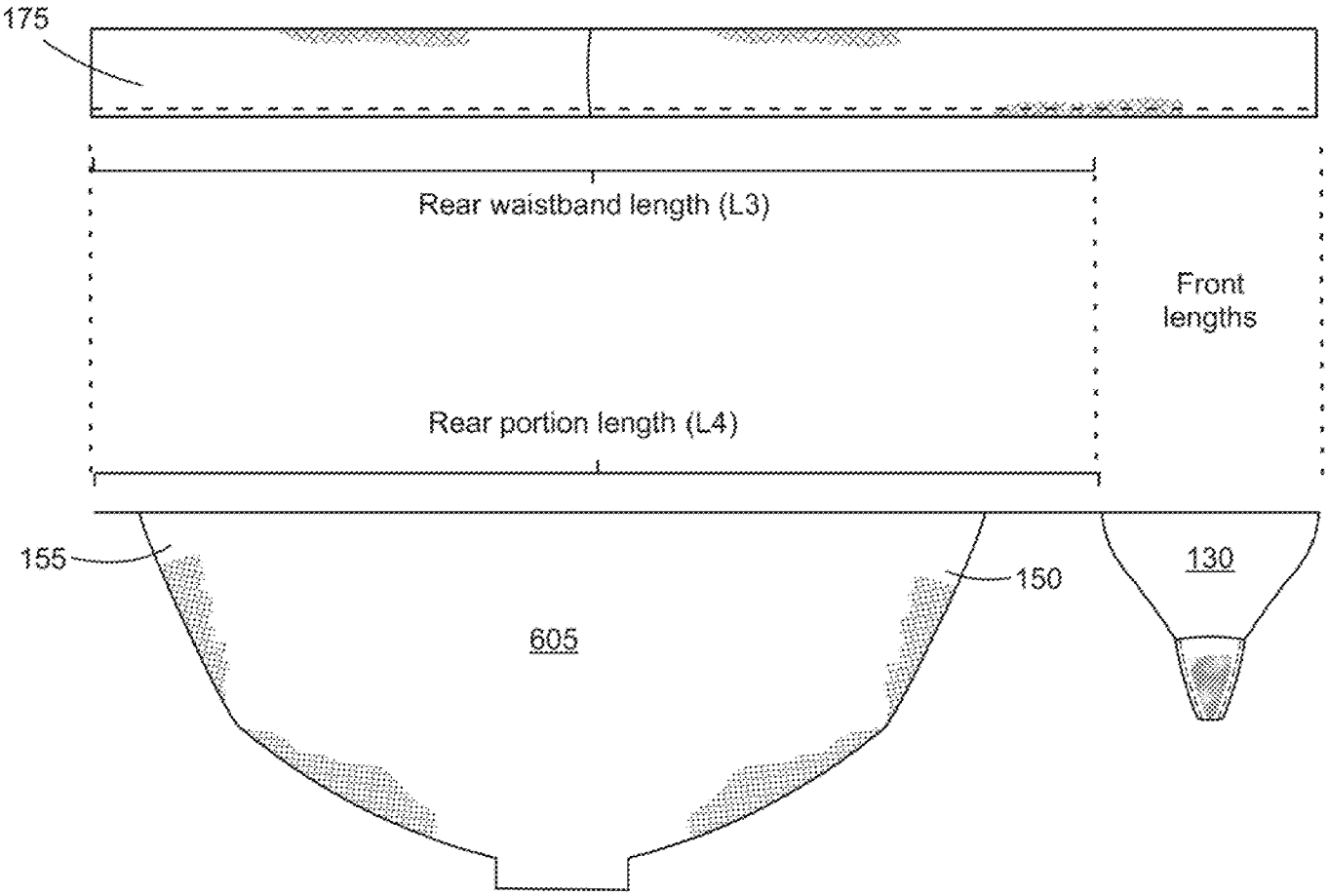
FIG. 7 shows an illustrative representation of the underwear with the waistband detached from the bottom portion.

FIG. 6 shows an illustrative representation of a rear waistband 175 and rear portion 605 of the lower half 165 of the medicinal underwear 105. The rear waistband and rear portion is positioned on a rear of a user's body when the medicinal underwear is worn. FIG. 7 shows an illustrative representation in which the rear waistband length has a length of L3 (Length 3) and the rear portion length has a length of L4 (Length 4).

The representation in FIG. 7 shows the medicinal underwear 105 in a flat and opened position to show the various lengths. As shown, the rear waistband and rear portions can extend around the sides and to the front of the wearer in some scenarios, such as depending on the wearer's size and shape and the size of the medicinal underwear. The configuration of the rear waistband and rear portion to extend around the side and toward the front of the user helps keep the medicinal underwear secure in a way that reduces pressure on the wearer's legs, hip crease, and other areas.

In typical implementations, the rear waistband 175 length is 10 percent shorter than the length of the rear portion 505 of the lower half fabric. Thus, for example, the rear portion may be eight inches long and the rear waistband portion may be 7.2 inches long (i.e., ten percent shorter). In other implementations, the rear waistband length can be anywhere from five percent to 25 percent shorter than the length of the rear portion. The exact lengths may vary based on the size (e.g., small, medium large, etc.). As discussed above with respect to FIG. 2, discussions of the length of the fabric pertain to the amount of fabric used and the ultimate length of the stretched or un-stretched fabric, so long as the comparison is based on both pieces of fabric being similarly stretched or un-stretched.

Figure 8:
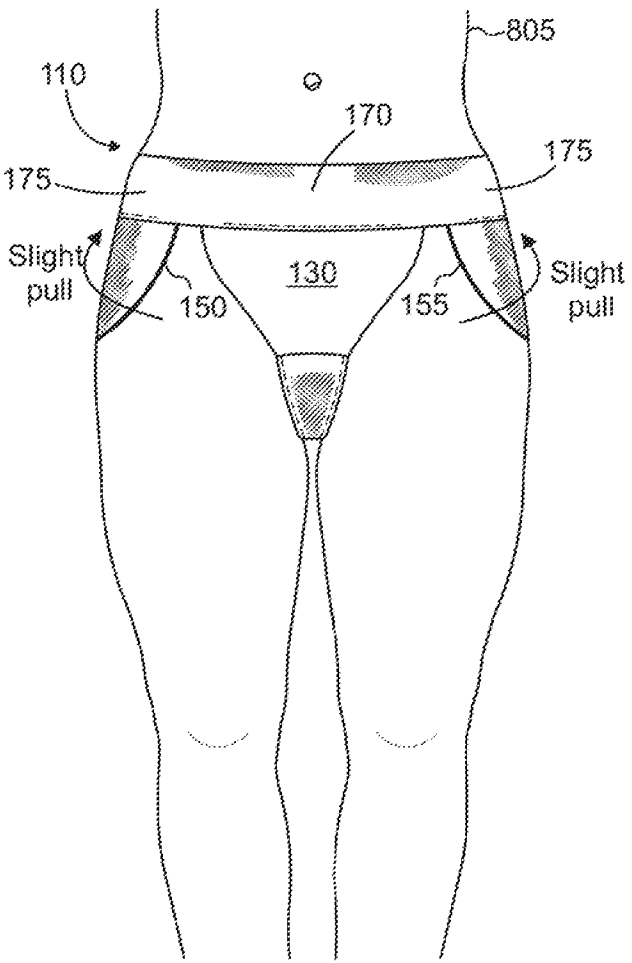
FIG. 8 shows an illustrative representation of the medicinal underwear from the front side view while worn.

The shorter length for the rear waistband portion 175 relative to the rear portion 605 enables a little stretch with minimal pressure to maintain the medicinal underwear's position while worn. For example, as shown in FIG. 8, the left and right side regions 150, 155 have slight tension toward the rear of the underwear which causes the side regions to secure the medicinal underwear 105 to the user's body and prevent the garment from falling. This minor tension enables loose- and easy-fitting of the medicinal underwear to stay in place during use.

Figure 9:
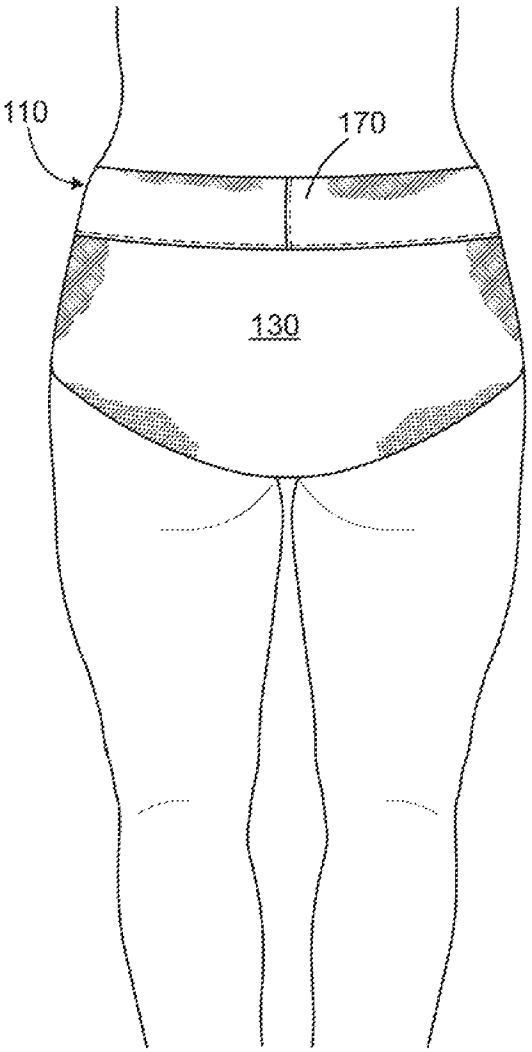
FIG. 9 shows an illustrative representation of the medicinal underwear from the rear side view while worn.
Figure 10:
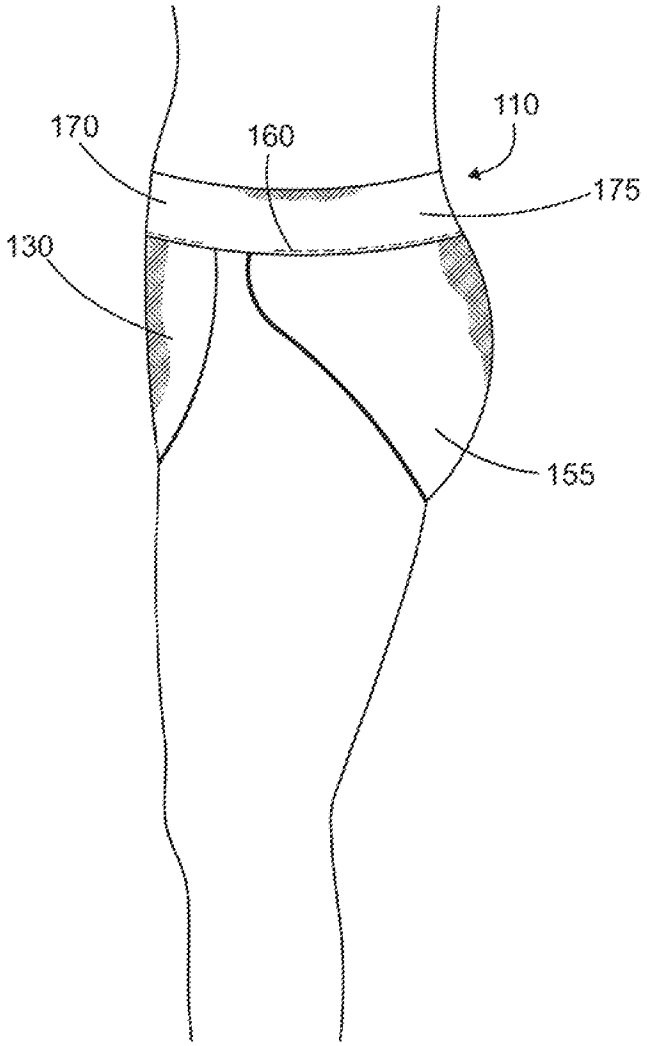
FIG. 10 shows an illustrative representation of the medicinal underwear from the right side view while worn.

FIGS. 9 and 10 show illustrative representations of the medicinal underwear from a rear and left side view, respectively. The right side view (not shown) is a mirror image of the left side view. As illustrated in FIG. 10, the right side region 155 extends from the user's rear, around the side of the user's leg, and to the front of the user's thigh.

Various implementations for the medicinal underwear are available. In one example, a medicinal pair of underwear is configured to reduce pressure while being worn, in which the medicinal underwear includes: an elastic front waistband portion; an elastic rear waistband portion connected to the front waistband portion; a front portion connected to and positioned laterally beneath the front waistband portion, wherein a length of the front portion is substantially the same as a length of the front waistband portion; and a rear portion connected to and positioned laterally beneath the rear waistband portion, wherein a length of the rear waistband portion is less than a length of the rear portion.

In another example, the medicinal pair of underwear of claim 1, wherein the underwear is comprised of micro-modal fabric. In another example, when the medicinal pair of underwear is worn, the rear portion includes sufficient fabric to enable respective left and right side regions on the rear portion of the underwear to wrap around a wearer's thigh and extend to respective front regions of the wearer's legs. In another example, the edges around the left and right leg openings are seamless to reduce tension exerted against any one or more of the wearer's legs, or hip crease. In another example, the front and rear waistbands are distinct components from the front and rear portions of the underwear, and in which the front and rear waistbands are stitched to the front and rear portions, respectively. As another example, the sewed stitching extends laterally across the waistband. A further example includes a gap in between the stitching that is positioned between the front waistband portion and the rear waistband portion, in which the gap reduces pressure applied against a wearer's legs and hip crease. Another example further comprises a cut-out of material on an inside fabric of the waistband to further reduce tension while worn, in which the inside fabric is that which is pressed against the wearer's body when the medicinal pair of underwear is worn. As another example, the cut-out forms a U- or V-shape. In another example, stitching around the cut-out is on the inside fabric to the front portion.

Another example includes a pair of underwear configured to reduce tension against a user's legs and hip crease while worn, comprising: a front waistband portion; a rear waistband portion connected to the front waistband portion; a front portion connected to and positioned laterally beneath the front waistband portion, wherein a length of the front portion is substantially the same as a length of the front waistband portion, and the front waistband portion is connected to the front portion with stitching; and a rear portion connected to and positioned laterally beneath the rear waistband portion, and wherein the rear waistband portion is connected to the rear portion with stitching, wherein a gap exists between the stitching for the front waistband portion and the rear waistband.

In another example, the front and rear waistband portions are elastic. As another example, a length of the rear waistband portion is less than a length of the rear portion. As another example, a portion of fabric from the rear portion extends around a side of a user to a front side of the underwear. In another example, the rear waistband portion has less length relative to the rear portion, and the extension of the rear portion to the front side of the underwear enables the underwear to secure to the wearer's body while reducing pressure on the legs. In another example, the rear waistband is anywhere from 5-25 percent shorter than the length of the rear portion. In another example, respective leg portions of the front portion and rear portion are seamless to reduce pressure when worn.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A medicinal pair of underwear configured to reduce pressure while being worn, comprising:

a waistband having an elastic front waistband portion and an elastic rear waistband portion connected to the elastic front waistband portion, wherein an outside fabric of the entire waistband is constant and free from gaps of material;

a front portion connected to and positioned laterally beneath the elastic front waistband portion, wherein a length of the front portion is substantially the same as a length of the elastic front waistband portion, wherein the elastic front waistband portion is stitched to the front portion;

a rear portion connected to and positioned laterally beneath the rear waistband portion;

two gaps in stitching on the outside fabric of the waistband and adjacent to the elastic front waistband portion, wherein the gaps in stitching are positioned on opposite sides of the elastic front waistband portion, in which the gaps in stitching reduce pressure applied against a wearer's legs and hip crease; and cut-out areas of material through an inside fabric of the waistband to further reduce tension while worn, in which the inside fabric is that which is pressed against the wearer's body when the medicinal pair of underwear is worn, and wherein the cut-out areas locations correspond to a location of the two gaps in stitching.

2. The medicinal pair of underwear of claim 1, wherein the underwear is comprised of micro-modal fabric.

3. The medicinal pair of underwear of claim 1, wherein, when the medicinal pair of underwear is worn, the rear portion includes sufficient fabric to enable respective left and right side regions on the rear portion of the underwear to wrap around a wearer's thigh and extend to respective front regions of the wearer's legs.

4. The medicinal pair of underwear of claim 3, wherein edges around left and right leg openings are seamless to reduce tension exerted against any one or more of the wearer's legs, or hip crease.

5. The medicinal pair of underwear of claim 1, wherein the stitching extends laterally across the waistband.

6. The medicinal pair of underwear of claim 1, wherein the cut-out areas form a U- or V-shape.

* * * * *